US007872186B1

(12) United States Patent
Tatman

(10) Patent No.: US 7,872,186 B1
(45) Date of Patent: Jan. 18, 2011

(54) BASSOON REED WITH TUBULAR UNDERSLEEVE

(76) Inventor: Thomas Tatman, 2703 73rd St., Kenosha, WI (US) 53143

( * ) Notice: Subject to any disclaimer, the term of this patent is extended or adjusted under 35 U.S.C. 154(b) by 0 days.

(21) Appl. No.: 12/507,844

(22) Filed: Jul. 23, 2009

(51) Int. Cl.
*G10D 3/04* (2006.01)

(52) U.S. Cl. ..... 84/380 R

(58) Field of Classification Search ..... 84/380 R, 84/383 R, 383 A
See application file for complete search history.

(56) References Cited

U.S. PATENT DOCUMENTS 4,014,241 A 3/1977 Gamble
4,355,560 A * 10/1982 Shaffer ..... 84/383 A
4,596,175 A 6/1986 Dossekker
5,192,821 A 3/1993 Goldstein et al.
6,087,571 A 7/2000 Legere
6,150,593 A 11/2000 Holden
6,706,958 B1 3/2004 Mitacek
7,098,391 B2 * 8/2006 Wilson ..... 84/453

FOREIGN PATENT DOCUMENTS

FR 2837608 A1 * 9/2003

* cited by examiner

*Primary Examiner*—Kimberly R Lockett
(74) *Attorney, Agent, or Firm*—Jansson Shupe & Munger Ltd.

(57) ABSTRACT

A bassoon reed including first and second reed cane members and a tubular undersleeve within, and a method of manufacture therefor is disclosed. The first and second reed cane members each have inside and outside surfaces, proximal and distal end portions and two opposite longitudinal edges. The reed cane members are secured together in edge-to-edge fashion along the distal end portions. The tubular undersleeve is within and supports the distal end portions therearound.

18 Claims, 4 Drawing Sheets

BASSOON REED WITH TUBULAR UNDERSLEEVE

FIELD OF THE INVENTION

This invention relates to double reeds for musical instruments and more specifically to a bassoon reed with a tubular undersleeve.

BACKGROUND OF THE INVENTION

The bassoon is a double reed instrument within the woodwind family of instruments. The bassoon relies on a double reed as its vibrational source for musical sounds. Traditionally, the musician blows through the double reed and vibrations are created as the reed opens and closes rapidly. These vibrations travel through the instrument and the musician is able to make musical sounds.

A bassoon reed is traditionally much larger in size than other reeds used in different double reed musical instruments of the woodwind family. For example, an oboe reed is smaller than a bassoon reed and therefore, will not create the same musical sounds as a bassoon. Oboe reeds and bassoon reeds are not compatible as they are two different types of double reeds.

Double reeds have traditionally been constructed from two pieces of cane. The two pieces are dimensionally the same and are bound together by some sort of ligature such as wire or thread. A sealant such as glue is typically applied to make the seal between the two pieces of cane airtight.

Bassoon reeds in the prior art are either constructed entirely of reed cane or are synthetically made of plastic or some other suitable material. Bassoon reeds made of cane are subject to problems. One such problem is that no two pieces of reed cane are alike. Reed cane is not consistent in quality, density, grain configuration or curvature.

These inconsistencies can result in a double reed which does not work properly or which emits a low quality sound which is inconsistent and undesirable.

Synthetic bassoon reeds of the prior art also suffer from certain shortcomings. Examples of these prior art devices are disclosed in the following United States patents: U.S. Pat. No. 6,087,571 (Legere) and U.S. Pat. No. 4,014,241 (Gamble). Most musicians prefer to use natural reed instead of a reed which has been synthetically manufactured. The synthetic reed manufacturers of the prior art have not been successful in creating a synthetic reed which delivers a high quality and consistent sound, similar to what is experienced with a reed made from reed cane.

It would be desirable to have a bassoon reed which overcomes these problems by being made of reed cane but which has a tubular sleeve inserted into the end of the reed, thereby reducing some of the usual inconsistencies associated with reed cane material while also providing a sound superior to the synthetic and traditional cane reeds in the prior art.

This device meets these needs and overcomes other problems and shortcomings in the prior art with a bassoon reed having a tubular sleeve inserted therein that delivers a highly quality and consistent sound.

OBJECTS OF THE INVENTION

It is an object of this invention, to provide a bassoon reed which overcomes certain problems and shortcoming of the prior art including those referred to above.

Another object of this invention is to provide a bassoon reed which provides superior sound quality over the prior art.

Yet another object of the invention is to provide a bassoon reed which reduces the inconsistencies associated with reed cane.

These and other objects of the invention will be apparent from the following descriptions and the drawings.

SUMMARY OF THE INVENTION

The invention is a bassoon reed for use in playing a bassoon. In its most preferred form, the device includes first and second reed cane members each having inside and outside surfaces, proximal and distal end portions and two opposite longitudinal edges. It is most preferred that the reed cane members are secured together in edge-to-edge fashion along overlying distal end portions. It is highly preferred that a tubular undersleeve is inserted within the distal end portions and supports the distal end portions therearound.

Preferably the tubular undersleeve is metal. It is highly preferred that the tubular undersleeve is made of brass and that the tubular undersleeve extends from a distalmost end of the overlying distal end portions along a majority of the length of the overlying distal end portions.

It is also preferred that the reed cane members are secured together at the distal end portions by thread-windings and by at least one wire-winding. It is most preferred that at least three wire-windings be used to secure the reed cane members together. It is highly desirable that an adhesive layer is placed around the distal end portions and at least on the thread-windings. It is highly preferred that the proximal end portions of the first and second reed cane members are spaced apart to facilitate air flow between the reed cane members.

It is highly preferred that the method of making a bassoon reed, includes providing first and second reed cane members each having inside and outside surfaces, proximal and distal end portions and two opposite longitudinal edges; securing the first and second reed cane members together in overlying edge-to-edge fashion by wrapping windings around the overlying distal end portions and inserting a tubular undersleeve into the distal end portions of the reed cane members.

Preferably the securing step further includes applying an adhesive around the distal end portions and at least on the thread-windings. It is highly preferred that the inserting step includes removing a portion of the inside surfaces of the first and second reed cane members to facilitate insertion of the tubular undersleeve.

The term "undersleeve" as used herein refers to a tubular member on the inside of the distal end portions of the reed cane members.

BRIEF DESCRIPTION OF THE DRAWINGS

The drawings illustrate a preferred embodiment including the above-noted characteristics and features of the device. The device will be readily understood from the descriptions and drawings. In the drawings.

DETAILED DESCRIPTION OF PREFERRED EMBODIMENTS

Figure 1:
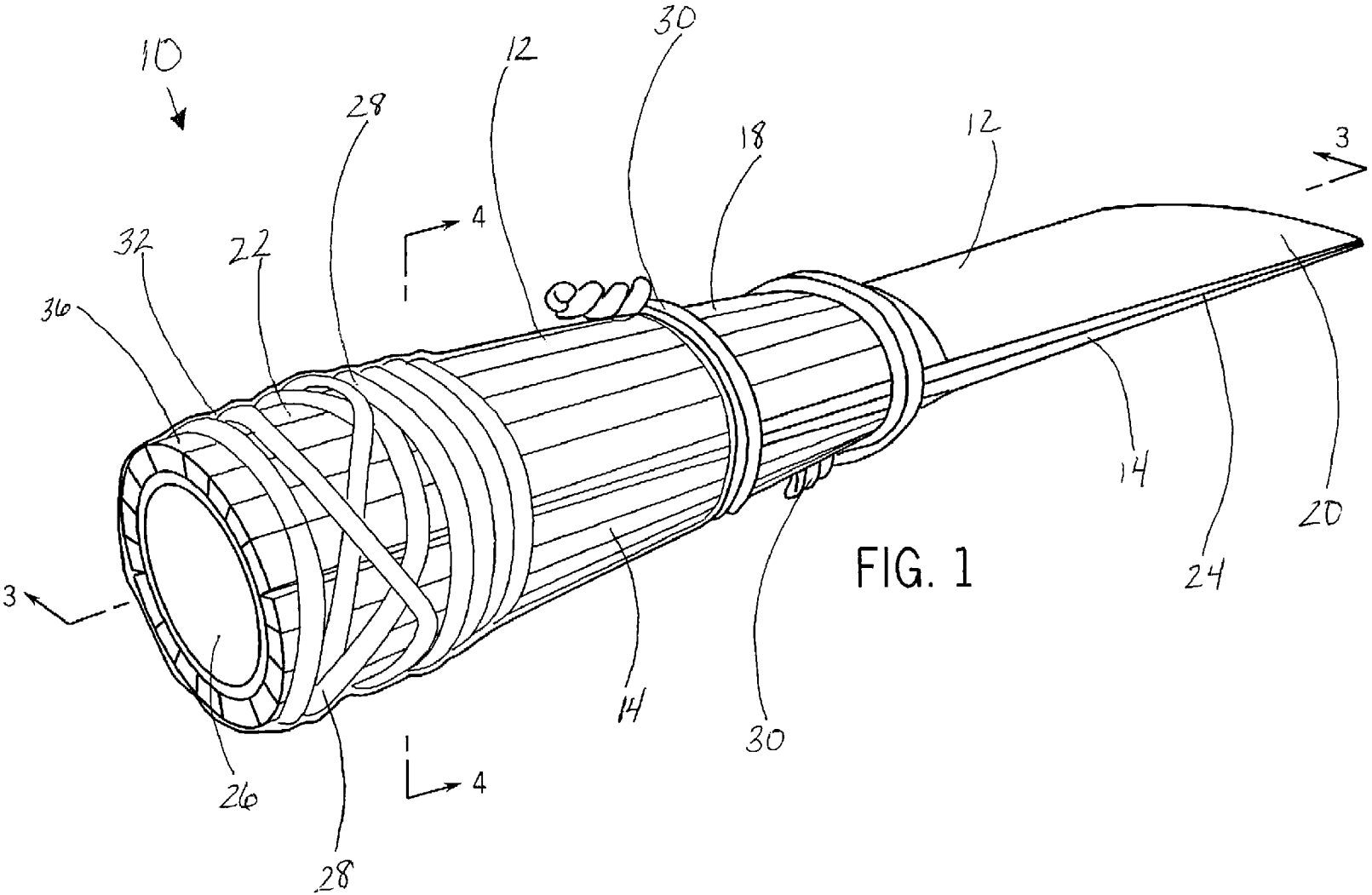
FIG. 1 is a perspective view of the device.

The figures and the description below serve to describe the details of the device.

Bassoon reed 10, like traditional bassoon reeds (also referred to as a "double reed"), is the vibrational source which creates musical sounds when the musician blows into the reed. Bassoon reed 10 fits onto the small end of the bocal pipe of the bassoon, which is inserted into the body of the bassoon.

FIGS. 1-4 illustrate a bassoon reed 10 including first and second reed cane members 12, 14. Each reed cane member 12, 14 has inside and outside surfaces 16, 18. proximal and distal end portions 20, 22 and two opposite longitudinal edges 24 as illustrated in FIGS. 1-4. Reed cane members 12, 14 are secured together in an edge-to-edge fashion along overlying distal end portions 22. Within and supporting the distal end portions 22 is a tubular undersleeve 26 as shown in FIGS. 1-4.

The use of the tubular undersleeve 26 which is inserted in the distal end portions 22 of reed cane members 12, 14 provides a superior quality and consistent sound over a synthetic reed or traditional all-cane reed. Tubular undersleeve 26 is not highly effected by weather. altitude or humidity fluctuations as are other reeds in the art. It is also not highly effected by saliva or moisture which can accumulate in the reed through the normal use of playing a woodwind instrument (the musicians breath which blows through the reed cane tube contains moisture).

The tubular undersleeve 26, which is shaped into a tube formation before insertion into the reed cane members 12, 14, is not limited to being manufactured from a certain type of metal or plastic. Many metal or plastic compositions would be adequate. However, it is highly preferred that tubular undersleeve 26 be made of metal, specifically brass.

Tubular undersleeve 26 extends from a distalmost end 36 of the overlying distal end portions 22 along a majority of the length of the overlying distal end portions 22. In some embodiments, tubular undersleeve 26 is approximately 14 mm in length, however, tubular undersleeve 26 can be made in a variety of lengths and widths.

Figure 3:
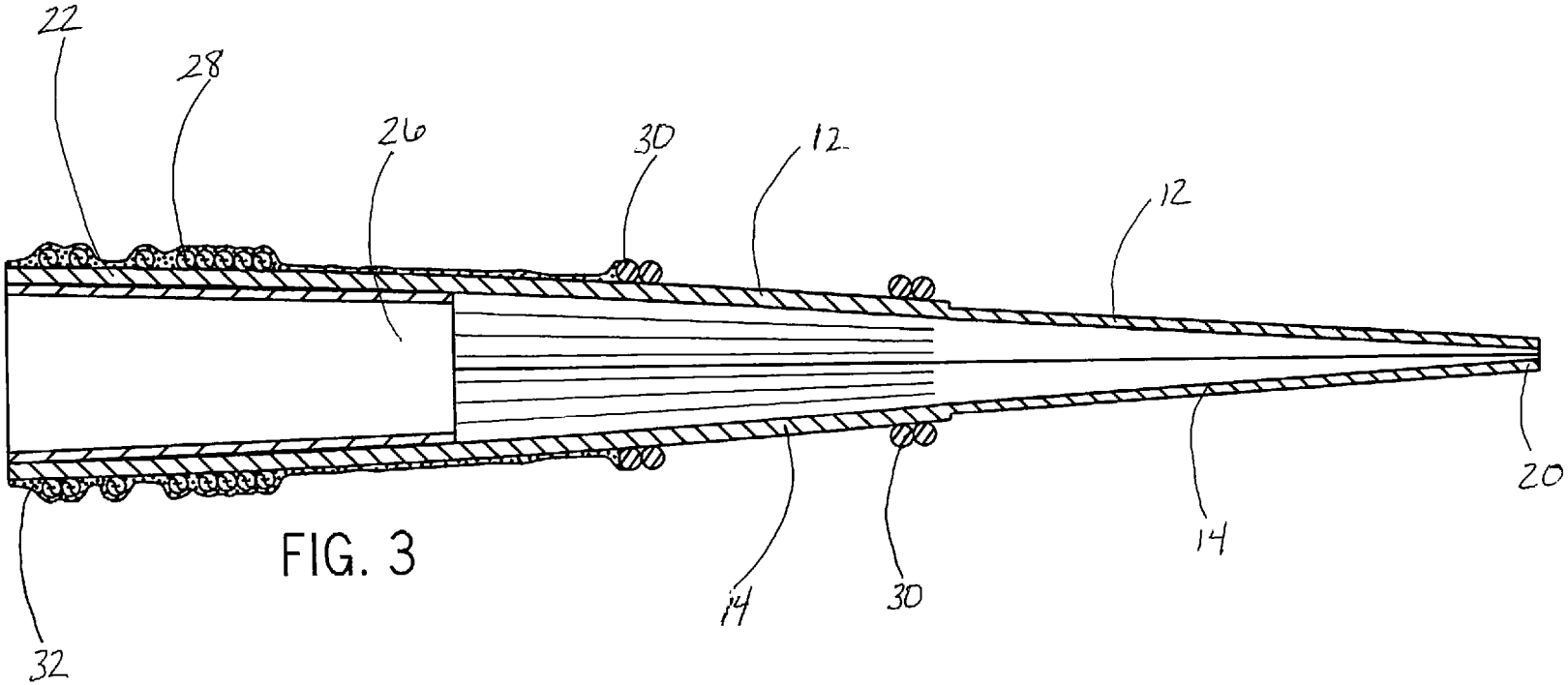
FIG. 3 is a sectional view of the device of FIG. 1 taken along section line 3-3 of FIG. 1.

Reed cane members 12, 14 are secured together at distal end portions 22 by thread-windings 28 and by at least one wire-winding 30 as illustrated in FIG. 1. Bassoon reed 10 as set forth in the claims is comprised of first and second reed cane members 12, 14 and other components such as wire-windings 30, preferably made of soft brass wire (preferably 22 gauge brass wire) as illustrated in FIGS. 1 and 3. In some embodiments, bassoon reed 10 includes three wire-windings 30 which secure distal end portions 22. In other embodiments, bassoon reed 10 includes one, two or more wire-windings 30.

Figure 4:
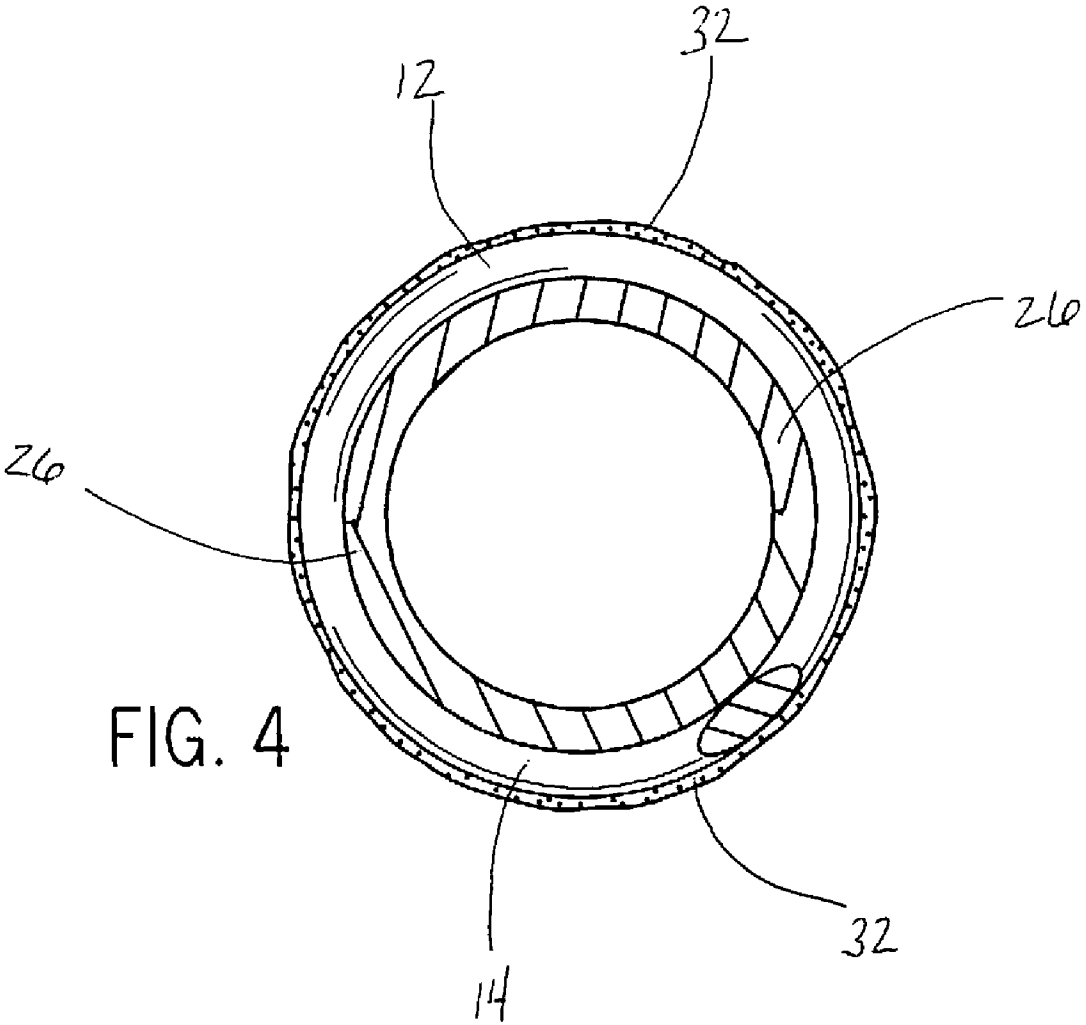
FIG. 4 is a sectional view of the device of FIG. 1 taken along section line 4-4 of FIG. 1.

FIGS. 1 and 3 illustrate that bassoon reed 10 also includes thread-windings 28, preferably made of double f-nylon thread (or another suitable type of string or thread). Adhesive layer 32 is preferably placed around distal end portions 22 and at least on thread-windings 28 as shown in FIGS. 3-4. Preferably, adhesive layer 32 is made of a sealing agent such as glue. Adhesive layer 32 is applied to ensure the seal between the first and second reed cane members 12, 14 is airtight.

Proximal end portions 20 of first and second reed cane members 12, 14 are spaced apart to facilitate air flow between reed cane members 12, 14 as shown in FIG. 3. Air flow must be allowed to pass between reed cane members 12, 14 in order for bassoon reed 10 to properly work and emit sounds.

Traditional tools are used to construct bassoon reed 10. These tools include but are not limited to, a mandrel, pliers, knives, files and sand paper. The method as claimed in the claims includes inserting a tubular undersleeve 26 into distal end portions 22 of first and second reed cane members 12, 14 (which are sealed together by an adhesive layer 32 prior to insertion).

The claimed method consists of providing first and second reed cane members 12, 14 each having inside and outside surfaces 16, 18, proximal and distal end portions 20, 22 and two opposite longitudinal edges 24 as seen in FIG. 1. Next, first and second reed cane members 12, 14 are secured together in overlying edge-to-edge fashion by wrapping wire-windings 30 around the overlying distal end portions 22. Finally, tubular undersleeve 26 is inserted into distal end portions 22 of first and second reed cane members 12, 14.

During the securing step adhesive layer 32 is applied around distal end portions 22 and at least on thread-windings 28. The inserting step of the claimed method further includes removing a portion of the inside surfaces 16 of first and second reed cane members 12, 14 prior to insertion of tubular undersleeve 26. Removing a portion of inside surfaces 16 facilitates easy insertion of tubular undersleeve 26.

Figure 2:
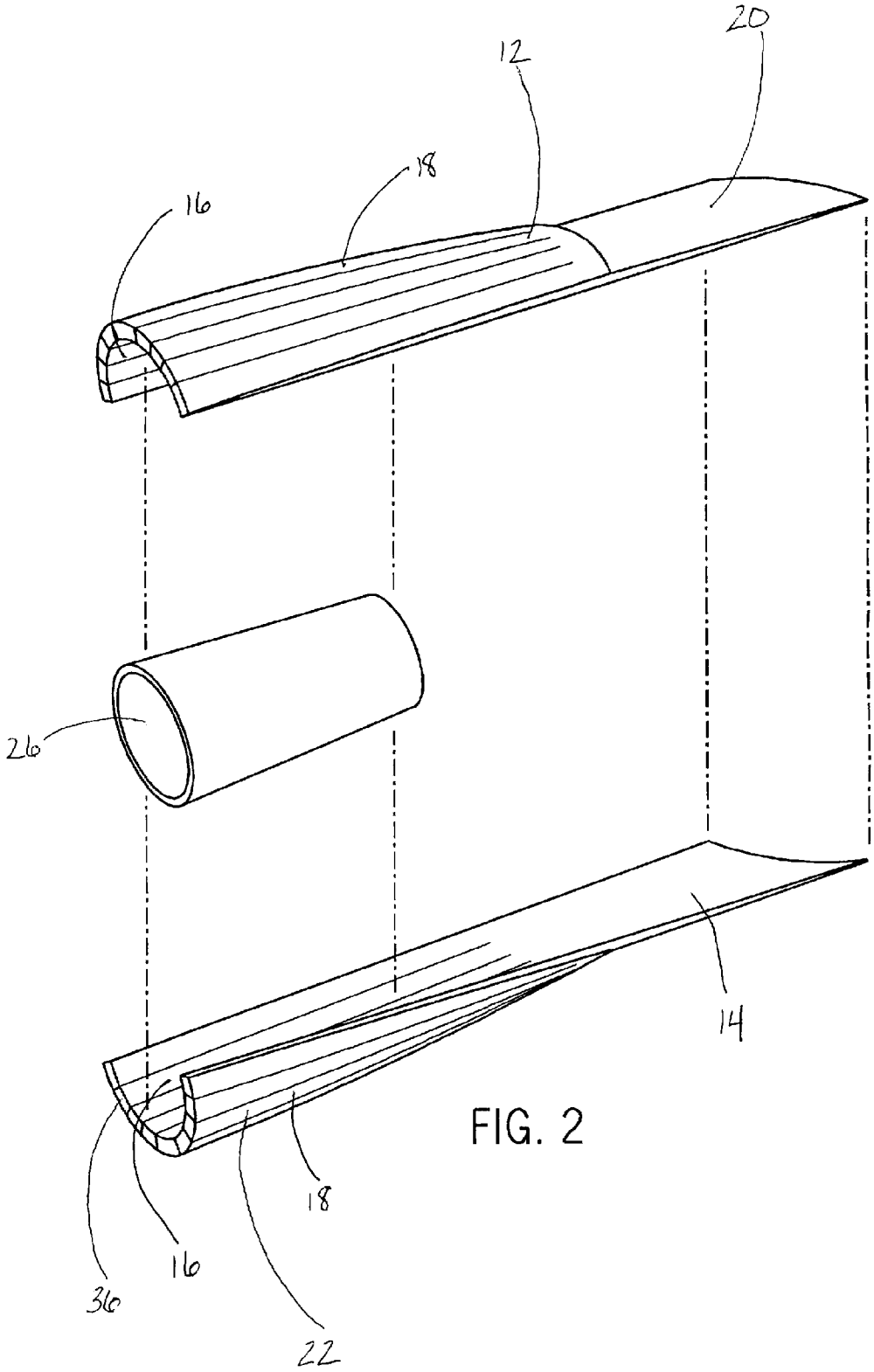
FIG. 2 is an exploded view of the device of FIG. 1.

Tubular undersleeve 26 is inserted into first and second reed cane members 12, 14 approximately 14 mm as shown in FIGS. 1-2. Tubular undersleeve 26 replaces a portion of the traditional natural reed cane interior surfaces 16 of first and second reed cane members 12, 14.

Bassoon reed 10 provides the bassoon player with a consistent pitch, improved projection control and acoustic consistency. Additionally, bassoon reed 10 is easy to play and retains the traditional sound of the bassoon. Bassoon reed 10 has a highly consistent interior wall structure as it limits any shrinking or swelling due to changes in humidity, weather, altitude, saliva contact or moisture from the musicians breath.

A wide variety of materials are available for the various parts discussed and illustrated herein. Although the device has been shown and described in conjunction with specific embodiments thereof, it is to be understood that many alternatives, modifications and variations will be apparent to those skilled in the art. Accordingly, it is intended to embrace all such alternatives, modifications and variations that fall within the spirit and broad scope of the appended claims.

The invention claimed is:

1. In a bassoon reed including first and second reed cane members each having inside and outside surfaces, proximal and distal end portions and two opposite longitudinal edges, the reed cane members being secured together in edge-to-edge fashion along overlying distal end portions, the improvement comprising a tubular undersleeve within and supporting the distal end portions therearound, the reed cane members being secured together at the distal end portions by thread-windings and by at least one wire-winding.

2. The bassoon reed of claim 1 wherein the tubular undersleeve is metal.

3. The bassoon reed of claim 2 wherein the tubular undersleeve is brass.

4. The bassoon reed of claim 3 further comprising an adhesive layer around the distal end portions and at least on the thread-windings.

5. The bassoon reed of claim 3 wherein the proximal end portions of the first and second reed cane members are spaced apart to facilitate air flow between the reed cane members.

6. The bassoon reed of claim 1 wherein the distal end portions are secured together by three wire-windings.

7. The bassoon reed of claim 1 wherein the tubular undersleeve extends from a distalmost end of the overlying distal end portions along a majority of the length of the overlying distal end portions.

8. The bassoon reed of claim 7 wherein the reed cane members are secured together at the distal end portions by thread-windings and by at least one wire-winding.

9. The bassoon reed of claim 7 further comprising an adhesive layer around the distal end portions and at least on the thread-windings.

10. The bassoon reed of claim 7 wherein the proximal end portions of the first and second reed cane members are spaced apart to facilitate air flow between the reed cane members.

11. A method of making a bassoon reed comprising the steps of:

providing first and second reed cane members each having inside and outside surfaces, proximal and distal end portions and two opposite longitudinal edges;

securing the first and second reed cane members together at the distal end portions in overlying edge-to-edge fashion by wrapping windings around the overlying distal end portions; and inserting a tubular undersleeve into the distal end portions of the reed cane members.

12. The method of claim 11 wherein the securing step further includes applying an adhesive around the distal end portions and at least on the thread-windings.

13. The method of claim 11 wherein the inserting step further includes removing a portion of the inside surfaces of the first and second reed cane members to facilitate easy insertion of the tubular undersleeve.

14. In a bassoon reed including first and second reed members each having inside and outside surfaces, proximal and distal end portions and two opposite longitudinal edges, the reed members being secured together in edge-to-edge fashion along the distal end portions; the improvement comprising a tubular undersleeve within and supporting the distal end portions therearound, the reed cane members being secured together at the distal end portions by thread-windings and by at least one wire-winding.

15. The bassoon reed of claim 14 wherein the tubular undersleeve is metal.

16. The bassoon reed of claim 14 wherein the tubular undersleeve is brass.

17. The bassoon reed of claim 14 further comprising an adhesive layer around the distal end portions and at least on the thread-windings.

18. The bassoon reed of claim 14 wherein the proximal end portions of the first and second reed cane members are spaced apart to facilitate air flow between the reed cane members.

* * * * *